US005794533A

United States Patent [19]

Takai

[11] Patent Number: 5,794,533

[45] Date of Patent: Aug. 18, 1998

[54] SPEED CONTROL APPARATUS FOR WATERWAY TRAVELING VEHICLE

[75] Inventor: Yohei Takai, Tokyo, Japan

[73] Assignee: The Walt Disney Company, Burbank, Calif.

[21] Appl. No.: 295,781

[22] PCT Filed: May 18, 1993

[86] PCT No.: PCT/US93/04779

§ 371 Date: Jul. 13, 1995

§ 102(e) Date: Jul. 13, 1995

[87] PCT Pub. No.: WO93/23126

PCT Pub. Date: Nov. 25, 1993

[30] Foreign Application Priority Data

May 18, 1992 [JP] Japan ..... 4-148944

[51] Int. Cl.[6] ..... A63G 3/02

[52] U.S. Cl. ..... 104/73; 104/205; 188/62

[58] Field of Search ..... 104/59, 70, 72, 104/73, 249, 250; 188/38, 38.5, 62, 63

[56] References Cited

U.S. PATENT DOCUMENTS

| | | | |
|---|---|---|---|
| 1,591,566 | 7/1926 | Schmidt et al. . | |
| 3,404,635 | 10/1968 | Bacon et al. . | |
| 3,807,806 | 4/1974 | Takahashi | 104/73 |
| 3,830,161 | 8/1974 | Bacon . | |
| 4,063,517 | 12/1977 | Nardozzi, Jr. | 104/73 |
| 4,149,469 | 4/1979 | Bigler . | |
| 4,392,434 | 7/1983 | Durwald et al. | 104/73 |
| 4,543,886 | 10/1985 | Spieldiener et al. | 104/73 |
| 5,613,443 | 3/1997 | Ariga et al. | 104/170 |

FOREIGN PATENT DOCUMENTS

8806733 U 9/1988 Germany .

*Primary Examiner*—S. Joseph Morano
*Attorney, Agent, or Firm*—Pretty, Schroeder & Poplawski

[57] ABSTRACT

A speed control apparatus for a waterway traveling vehicle which can guide the vehicle when it is traveling along the waterway, while applying a damping force to slow or stop the vehicle. A turning frame is provided in the waterway and is guided by a guide member for angular movement. The turning frame is urged by a spring mechanism to align in a predetermined direction, and the damping mechanism is mounted on the turning frame. When the vehicle approaches the damping mechanism obliquely, the turning frame is angularly moved to make the damping mechanism align with the direction of vehicle travel. The damping mechanism is then returned to a predetermined direction under the restoring action of the spring mechanism. In this manner the direction of the vehicle is corrected to the proper direction and is slowed or stopped by the action of the damping mechanism.

24 Claims, 7 Drawing Sheets

SPEED CONTROL APPARATUS FOR WATERWAY TRAVELING VEHICLE

FIELD OF THE INVENTION

The present invention relates to an amusement park attraction in the form of water traveling vehicles traveling along a waterway or a waterway joined to a ground track, and more particularly to a control apparatus for slowing down or stopping such vehicles in the waterway.

DESCRIPTION OF THE RELATED ART

In amusement parks and so forth, one popular attraction ride has been of the type in which passengers travel in an amphibious vehicle, such as a pleasure launch or boat. In operation of such an amusement ride, a pleasure launch or boat is set afloat in an endless waterway in which water is flowing, and the boat travels with the water flow. A ground track, such as a railway track, can be installed on the ground adjoining the waterway to render an amphibious amusement ride by allowing the passenger carrying vehicle to travel along these ground tracks and waterways successively, so that passengers enjoy traveling over land and in water in one ride in a single amphibious vehicle. To advance such a pleasure vehicle, namely, a pleasure launch or boat, along a waterway, a water flow traveling method has been adopted by which water in the waterway is thrust to generate a recirculating flow and the boat is urged to go ahead with the water flow generated. In the case of adopting this type of traveling method, the boat cannot control its speed by itself and its travel is totally left to the water flow. When passengers board and leave the boat at a platform, for example, the boat must be stopped there, but the boat has no capability of slowing itself. Some apparatus is therefore required to speed down and stop the boat.

Another requirement of such an attraction ride is the control of the various vehicles with respect to one another. Typically, variations occur in the speed of travel of the different boats traveling along a waterway depending on factors such as the number of passengers on board, the weight of the boat itself, and the shape of the boat, as such factors directly affect boat speed. When a plurality of boats are set afloat in the same waterway and travel one after another, such variations in speed can result in boats overtaking one another due to a boat starting later traveling at a higher speed than a preceding boat. This may cause a potential hazard if the succeeding boat comes too near to the preceding boat or bumps against it. For this reason, means for adjusting intervals between boats is required.

Further, when a preceding boat is stopped at a platform, a succeeding boat is required to wait for the preceding boat to depart from the platform to avoid collision. From this viewpoint, too, an apparatus for controlling the speed of boats is required.

Additionally, in the case where various entertainments are provided in the course of the waterway and boats are sped down or stopped at places of those entertainments, allowing passengers to view and enjoy this entertainment, the interval between a preceding boat and a succeeding boat is desired to be kept greater. In that case as well, it is necessary to speed down or stop the boats and, therefore, a velocity damping apparatus is required for that purpose.

One such apparatus for damping the travel velocity of boats is proposed in Japanese Utility Model Publication No. 45-12594, for example. That apparatus includes an endless conveyor which is disposed parallel to the direction of advance of boats and serves to stop a boat when the boat approaches the conveyor with the aid of a water flow and the boat's bottom rides over the conveyor. Also, by forcibly running the conveyor, by a drive unit such as a motor, the boat can be thrust forward by the conveyor, so that the boat can be started moving to depart therefrom.

In the case of employing the above prior art damping and starting apparatus, unless the boat is guided to the conveyor in a proper direction or attitude, proper friction is not produced between the boat and the conveyor, creating the potential hazard of the boat running off the conveyor.

A further potential hazard in such an apparatus arises from the water flow itself. This is because the boat is still subjected to the water flow when it rides over the conveyor and is there stopped or sped down. If the boat is inclined with respect to the direction of the water flow, or supported by the damping apparatus with an attitude directing aslant, the surface area of the boat receiving the water flow is increased, and a large water pressure is applied to the boat. Therefore, the burden upon the damping apparatus, which has to damp the boat motion against such an increased water pressure, is increased remarkably.

In addition, while passengers are boarding and leaving the boat at a platform, the boat must be directed exactly parallel to the direction of water flow, facing toward the downstream direction of flow; otherwise the boat becomes so unstable that the passengers boarding and leaving it may feel uneasy.

Taking the above into account, in the proposed prior art apparatus, guide plates are provided on both left and right sides of a region of the waterway where the boat is to be stopped, making the width of the waterway narrowed and close to that of the boat. The boat is led to direct the front of the boat exactly with the chosen path for boat travel under a guide action of those left and right guide plates.

However, the above construction of the prior art apparatus has a number of problems. Equipment, including the guide plates installed to narrow the waterway, is so large in scale as to undergo limitations in placement of such equipment. It is inevitable for side panels of the boat to contact with the guide plates, resulting in the panel surfaces being worn away or paints coated on them being peeled off, hence an unsightly appearance. Additionally, the width of the waterway being close to the width of the boat raises the fear of a hazardous accident with respect to the passengers; that if a part of the body of any passenger is projecting out of the sides of the boat, it might be pinched between the guide plate and the boat.

SUMMARY OF THE INVENTION

The present invention has been made in view of the state of the art as mentioned above, and its object is to provide a speed control apparatus for a waterway traveling vehicle which can guide a vehicle traveling along a waterway with simple structure, and can positively transmit frictional damping forces to the vehicle for speeding down or stopping it.

To achieve the above object, the present invention provides a speed control apparatus for a vehicle used in an amusement ride in which a vehicle is set afloat in a waterway and moved along the waterway by the flow of water within it. A speed damping mechanism is provided in the course of the waterway which is positionable to come into contact with the vehicle and stop or slow said vehicle by a friction hold on the vehicle. A turning frame guided by a guide member to angularly rotate serves as the mounting for the speed damping mechanism, and the turning frame is positioned at a predetermined position along said waterway in an angularly movable manner. The turning frame is urged by spring means to be directed in a predetermined direction, and the damping mechanism is mounted to the turning frame such that when a vehicle approaches the damping mechanism obliquely with respect to a predetermined direction of advance, the turning frame is angularly moved against said spring means to bring the damping mechanism into alignment with the direction of the vehicle. Once aligned with the direction of the vehicle, the turning frame is then returned to the predetermined direction through reversed angular movement under an urging action of the spring means. Because the damping mechanism mounted on the turning frame is in contact with the vehicle, the return rotation of the turning frame rotates the vehicle, thus, correcting the direction of said vehicle to the proper, predetermined direction of advance.

With the present invention, when a vehicle such as a pleasure boat traveling along a waterway, approaches the damping mechanism obliquely, the turning frame is angularly moved to make the damping mechanism aligned with the direction of the vehicle and then returned to the predetermined direction through reversed angular movement under a restoring action of the spring means for returning the damping mechanism to its original direction, so that the direction of the vehicle is corrected to the proper direction of advance.

DETAILED DESCRIPTION OF THE PREFERRED EMBODIMENTS

Hereinafter, details of the present invention will be described in conjunction with a first embodiment shown in FIGS. 1 to 6.

Figure 6:
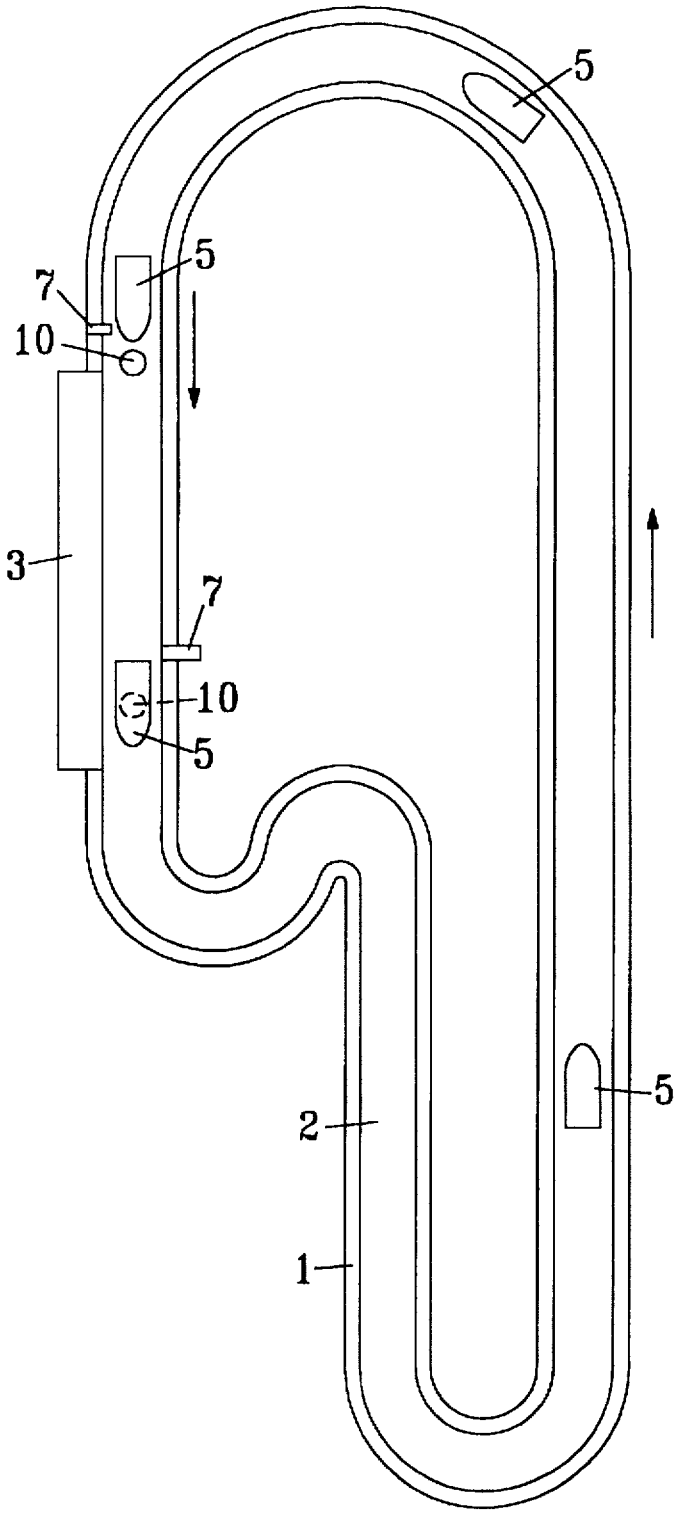
FIG. 6 is a top plan view of the waterway showing relative placement of sensors and speed control apparatus of the first embodiment.

FIG. 6 is a top plan view showing the whole of a waterway for a traveling vehicle in the form of a pleasure boat set in amusement parks. A waterway (1), contains water (2) which carries one or a plurality of pleasure boats (5). A platform (3) allows passengers to board and disembark from a particular boat (5). A plurality of speed control apparatus (10) are located at predetermined points along the waterway where speed control of the boat (5) is desired. Sensors (7) are positioned in proximately to the speed control apparatus (10) to sense the approach a boat (5) to and thereby activate speed control apparatus (10).

The waterway (1) in this embodiment is an endless waterway constructed using concrete or the like, and the water (2) is recirculated by a pump (not shown) to generate a flow of water in the direction indicated by arrows so that the boats (5) travel by riding on the water flow. The waterway is not limited to the illustrated endless waterway. As an alternative amusement attraction, a railway installed on the ground may be joined to a waterway, and an amphibious vehicle may travel along these railways and waterways successively, allowing the passengers to enjoy traveling over land and through water in a single amusement ride.

Figure 5:
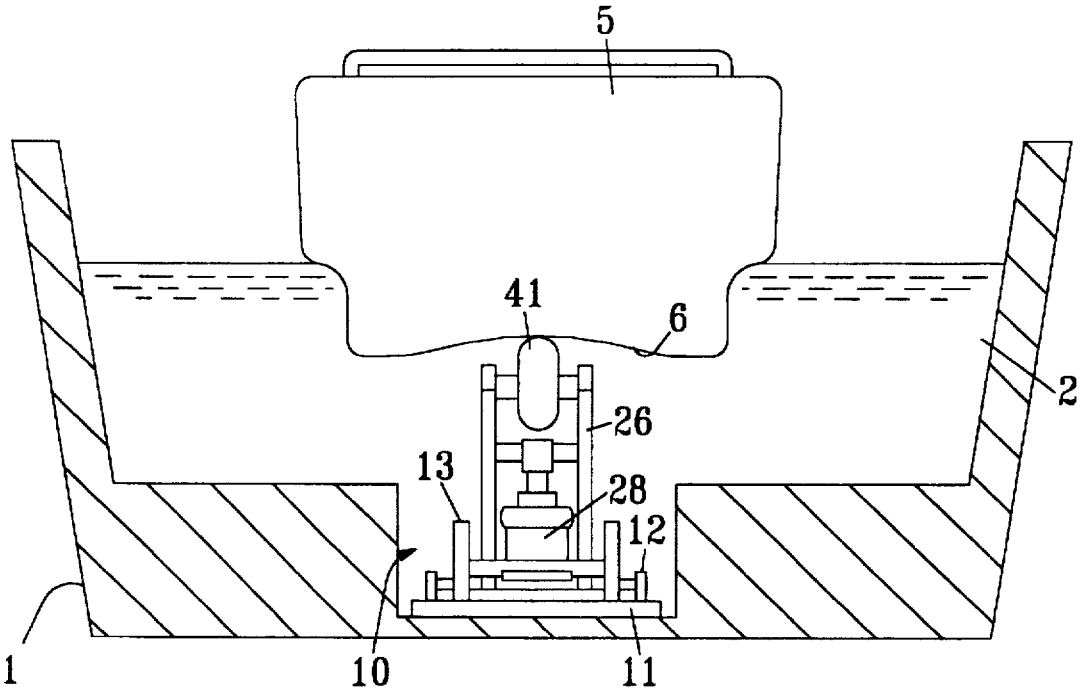
FIG. 5 is a sectional view of a waterway in the first embodiment.

Each of the pleasure boats (5) may be a single-sitter boat or a larger-sized boat for a plurality of passengers ranging from several to dozens of passengers. In either case, a bottom surface (6) on the underside of the boat (5) for use in this embodiment has an upwardly curved shape, i.e., a concave shape peaking at the bottom center of the boat, as shown in FIG. 5, the bottom surface (6) being utilized to guide the boat as explained later.

The speed control apparatus (10) for the pleasure boat (5) is installed at, for example, two locations; a position midway the boarding platform (3) and a position before, with respect to the travel direction of a boat, the platform (3) by a short predetermined distance. Each speed control apparatus (10) serves to speed down or stop the boat at the predetermined points in the waterway.

The speed control apparatus (10) is described in detail with reference to FIGS. 1 to 4.

Figure 4:
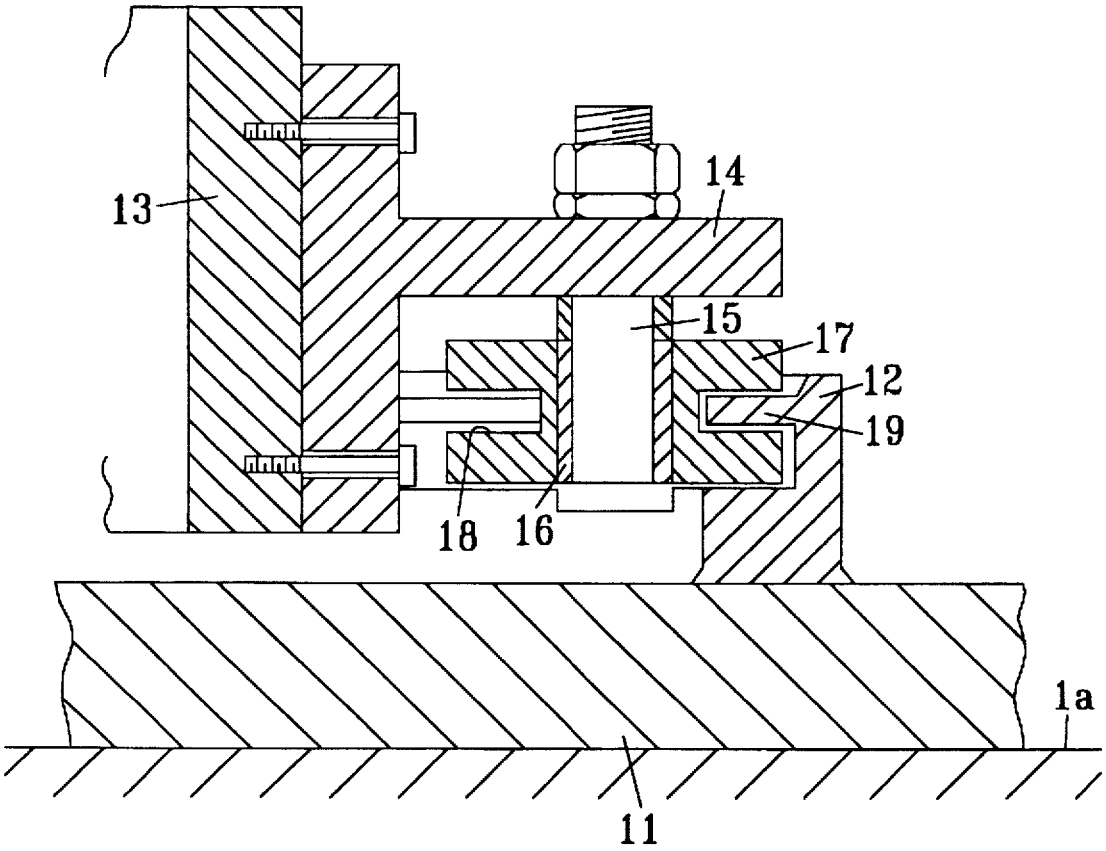
FIG. 4 is a sectional view taken along line B—B in FIG. 1.

A base (11) of the speed control apparatus (10), is installed on a bottom surface (1*a*) of the waterway (1) at each of the two aforesaid predetermined locations. A guide rail (12) having an annular shape in the plane defined by the bottom surface of the waterway, for example, is fixed to the base (11) and a turning frame (13) is mounted over the guide rail (12) in an angularly movable manner. The turning frame (13) is of substantially rectangular structure and has brackets (14) respectively fixed near its four corners. As shown in FIG. 4, a support pin (15) is attached to each of the brackets (14) and a rotary roller (17) is rotatably attached to the support pin (15) via a bushing (16). The rotary roller (17) has an annular groove (18) formed in its outer circumference, and the annular groove (18) is engaged with a guide rib (19) projecting from an inner circumference of the guide rail (12). Thus, the rotary rollers (17) provided near the four corners of the turning frame (13) are rotatably engaged with the guide rail (12) so that the turning frame (13) is mounted to be rotatable along the guide rail (12).

Hooks (20) are attached to the left and right sides of the turning frame (13), respectively, and hooks (21) are mounted to the base (11) in opposite relation to the hooks (20). Coil springs (22) are stretched between opposite pairs of the hooks (20) and (21). The coil springs (22) are provided on the left and right sides of the turning frame (13) to pull it from both sides, so that the turning frame (13) maintains a neutral position with respect to the pull of the springs from the right and the left. In other words, the turning frame (13) is forced to orient in a predetermined direction, coinciding with the direction of the water flow, under urging forces of the coil springs (22). If the turning frame (13) is subjected to such a force as breaking the balance in tensile force between the coil springs (22), the turning frame (13), thus, turns clockwise or counterclockwise (this can be seen in FIG. 1) along the guide rail (12) against the resilient forces of the coil springs (22). The angular range of motion in which the turning frame (13) is constrained by one of a plurality of stoppers (23) made of rubber or the like provided on the base against which turning frame (13) abuts upon undergoing a predetermined rotation. Thus, the turning frame (13) is restricted in its turning movement at about 45° on each of left and rights sides.

The turning frame (13) thus constructed includes an arm support shaft (25) attached to its one end on the upstream side in the direction of the water flow, and a lift arm (26) is mounted at one of its ends to the arm support shaft (25) in an angularly movable or pivotable manner. The lift arm (26) is comprised of a frame structure extending from its mounted end in the direction of the water flow. The downstream end of lift arm (26) is free, it and has a joint shaft (27) in its intermediate portion. An air cylinder (28) is interposed between the joint shaft (27) and the turning frame (13), and serves to angularly or pivotably raise and lower the lift arm (26) about the support shaft (25). A base end of the air cylinder (28) is mounted to the turning frame (13) via a mount shaft (29) in an angularly movable manner, while a knuckle (31) provided at a distal end of a piston rod (30) of the air cylinder (28) is mounted to the joint shaft (27) in an angularly movable manner. Therefore, when the air cylinder (28) is actuated to extend, the lift arm (26) is raised as indicated by imaginary lines in FIG. 2, and when the air cylinder (28) is actuated to contract, the lift arm (26) is lowered as indicated by solid lines in FIG. 2.

Figure 3:
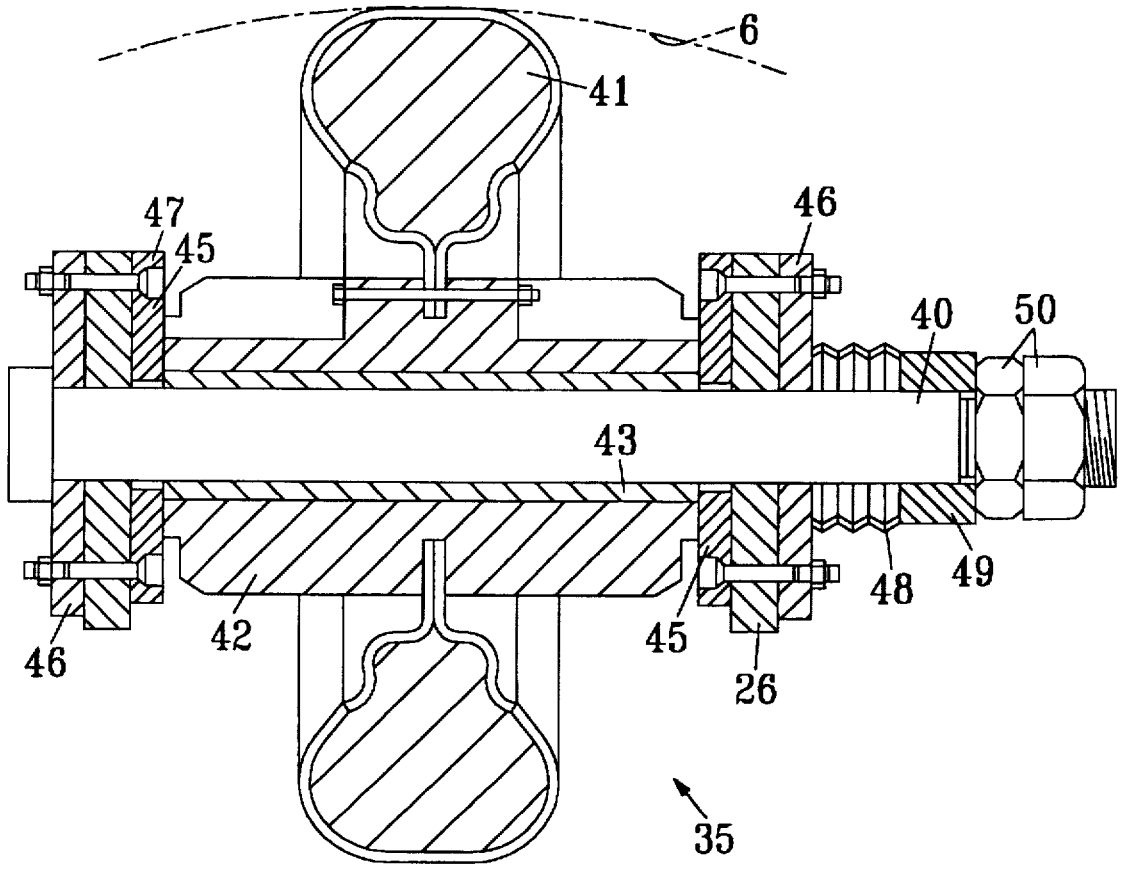
FIG. 3 is a sectional view taken along line A—A in FIG. 1.

A damping mechanism (35) is provided at the free end of the lift arm (26). More specifically, a tire support shaft (40) is transversely attached to the free end of the lift arm (26) on the downstream side in the direction of the water flow, and a rubber tire (41) as an elastic wheel is rotatably attached to the tire support shaft (40). As shown in FIG. 3, the rubber tire (41) is attached to a hub (42) and the hub (42) is rotatably supported on the tire support shaft (40) via a bushing (43).

The bottom surface (6) of the pleasure boat (5) rides over the rubber tire (41) as the boat (5) travels through the waterway (1). When the bottom surface (6) of the pleasure boat (5) makes contact with the rubber tire (41), the rubber tire (41) is caused to rotate by the friction generated between it and the moving bottom surface (6) of the passing boat (5). Friction plates (45) are fixed to an inner surface of the lift arm (26) at respective positions facing both ends of the hub (42). The friction plates (45) and reinforcing plates (46) tightly hold the lift arm (26) therebetween and are fixed together by bolts (47). Opposite end faces of the hub (42) are held in contact with the friction plates (45) so that, when the rubber tire (41) rotates, the hub (42) is also rotated while sliding at its opposite end faces over the friction plates (45). The sliding resistance generated by friction plates (45) against the hub (42) damps the rotation of the rubber tire (41) which rotates with hub (42).

A plurality of conical plate springs (48) are fitted over the tire support shaft (40) to press the outer surface of the lift arm (26) facing the conical plate springs (48) in spaced relation, whereby the friction plates (45) are pressed against the opposite end faces of the hub (42). Therefore, an increased sliding resistance is generated between the opposite end faces of the hub (42) and the friction plates (45). An initial load of the plural conical plate springs (48) is set by a spacer (49) and double nuts (50). Thus, the friction resistance between the hub (42) and the friction plates (45) can be adjusted by replacing the spacer (49) or changing a tightening force of the double nuts (50).

Additionally, a block (51) is welded to the lift arm (26) against which a cut surface of the tire support shaft (40) is abutted to prevent the tire support shaft (40) from rotating.

Operation of this embodiment thus arranged will be described below.

The pleasure boats (5) set afloat in the waterway (1) advance in the direction of the flow of the water (2) indicated by arrows. While one of the pleasure boats (5) is being stopped at the platform (3), passengers board and leave the boat. The speed control apparatus (10) for the pleasure boats are installed at predetermined positions, specifically midway along and before the platform (3), with respect to the direction of the travel of the boats, so that each of the pleasure boats (5) is stopped or sped down by the speed control apparatus (10) at predetermined positions.

More specifically, when one of the boats (5) to be stopped or sped down approaches the speed control apparatus (10), the sensor (7) installed in the waterway (1) senses the boat's approach and issues a command to extend the air cylinder (28) of the speed control apparatus (10). Upon the air cylinder (28) extending, the lift arm (26) is raised as indicated by imaginary lines in FIG. 2. Accordingly, the rubber tire (41) mounted to the free end of the lift arm (26) is elevated up to a position near the water surface where it awaits the oncoming boat.

When one of the pleasure boats (5) advances, in the direction of arrow, toward the speed control apparatus (10) when the lift arm (26) is raised, the bottom surface (6) of the boat comes into contact with the rubber tire (41). The contact between the bottom surface (6) and the rubber tire (41) brings them into frictionally engaged relation, whereby the rubber tire (41) is forced to rotate by the movement of advancing boat (5) frictionally engaged with it. The rotation of the rubber tire (41) causes the hub (42) to be rotated together therewith while sliding over the friction plates (45) which are held in contact with the opposite end faces of the hub (42). The rotation of the hub (42) is restricted because the opposite end faces of the hub (42) and the frictional plates (45) are subjected to predetermined forces of the friction resistance generated by the urging forces of the conical plate springs (48). In other words, when the rubber tire (41) is urged into rotation by contact with the passing boat (5), its rotation is restricted by the friction between the hub (42) and the friction plates (45), thereby speeding down the boat (5) in frictional contact with the rubber tire (41). Accordingly, when the boat (5) rides over the rubber tire (41), its speed is gradually slowed down and the boat (5) is finally stopped.

Figure 1:
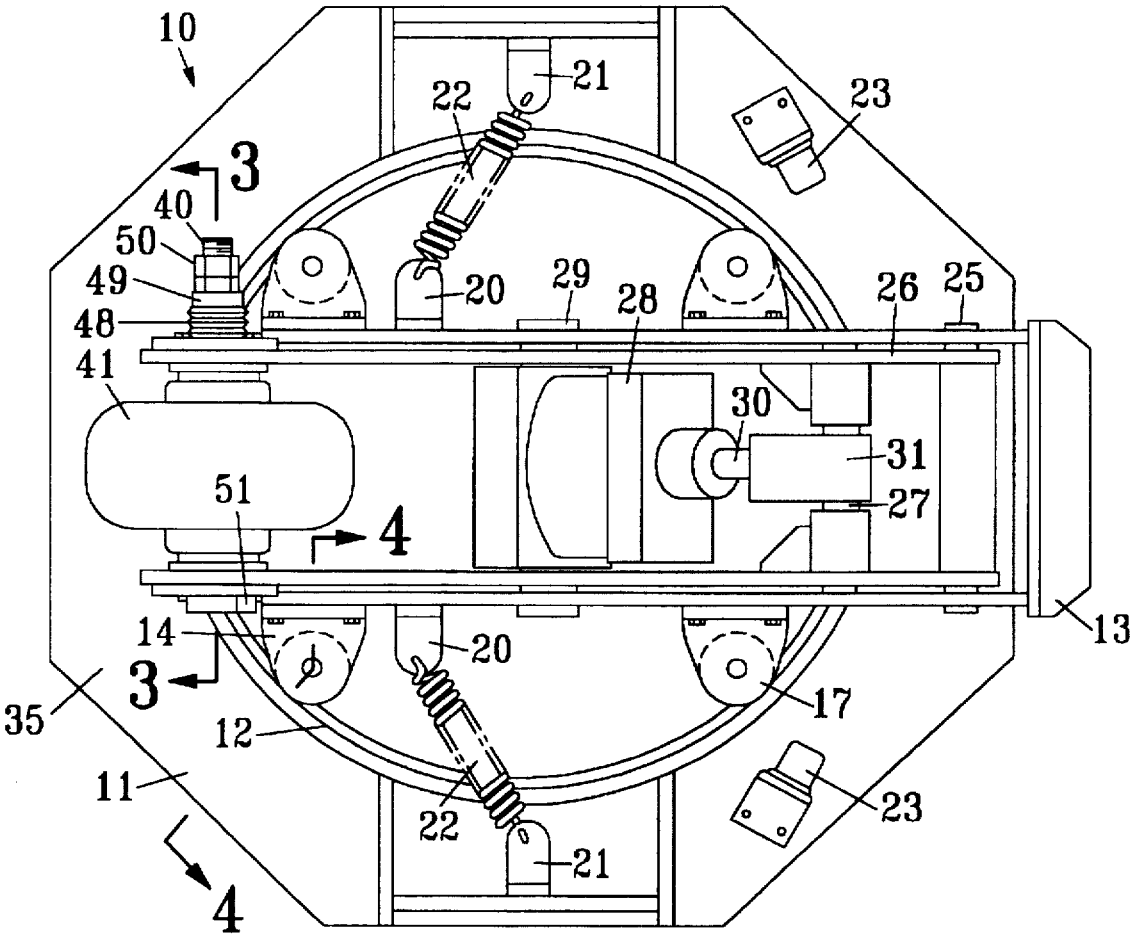
FIG. 1 is a top plan view of speed control apparatus showing a first embodiment of the present invention.
Figure 2:
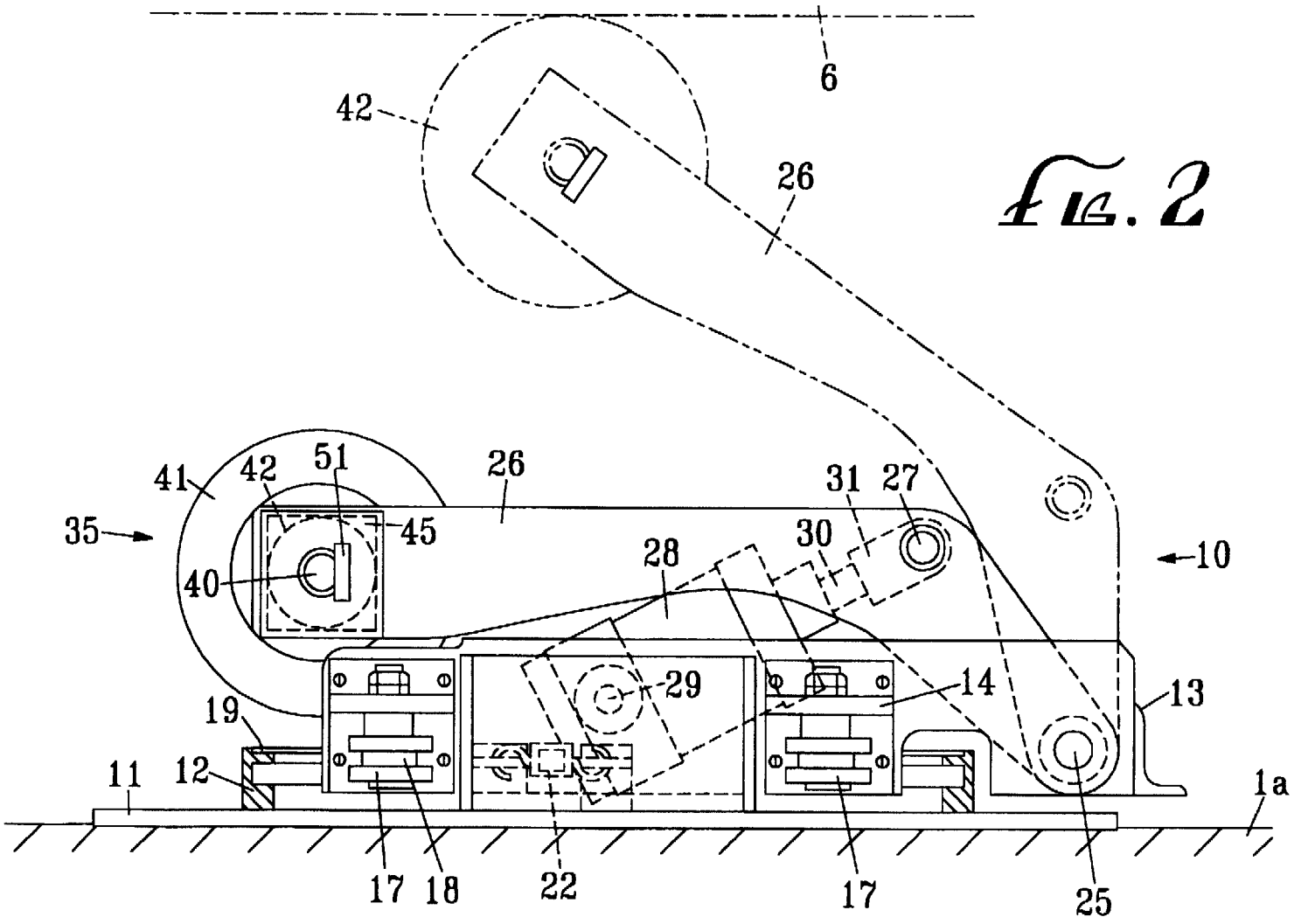
FIG. 2 is a side view of the apparatus according to the first embodiment.

When starting the boat (5) which is stopped or sped down by being held in contact with the rubber tire (41) as mentioned above, the air cylinder (28) is actuated to contract to lower the lift arm (26) as indicated by solid lines in FIG. 2. The rubber tire (41) at the free end of the lift arm (26) is then lowered to disengage from physical contact with the bottom surface (6) of the pleasure boat (5). Therefore, the boat (5) is released from a damped state of motion and thrust with the water flow to advance in the direction of arrow. As a result, the boat again (5) travels unimpeded, riding on the water flow.

Other than the above damping action upon the pleasure boat (5), the device of the invention also serves to steer the boat to set it on its proper course of travel. This is important since the boat (5) is propelled by riding on the flow of the water (2) and because the direction of travel is totally left to the water flow, succeeding boats may vary in their course of advance.

In this embodiment, while the bottom surface (6) of the pleasure boat (5) has a concave shape peaking at the center, a damping friction member against which the bottom surface (6) comes into frictional contact is the single rubber tire (41). Therefore, the concave-shaped bottom surface (6) and the rubber tire (41) act to mutually guide each other such that even if the rubber tire (41) comes into contact with the bottom surface (6) of the boat at a location offset from its center, it is guided by a curved slope of the bottom surface (6) so as to finally contact with the peak, i.e., the center, of the bottom surface.

Further, if the boat (5) travels in an attitude aslant with respect to the direction of the water flow and approaches the rubber tire (41) obliquely relative to its center line (i.e., the direction of the water flow), the front end of the bottom surface (6) of the boat is obliquely brought into frictional contact with the rubber tire (41). In this case, since the front end of the boat (5) obliquely pushes the rubber tire (41), the turning frame (13) supporting the rubber tire (41), is angularly moved against the urging forces of the coil springs (22), aligning the rubber tire (41) parallel to the hull. Upon the rubber tire (41) aligning parallel to the hull, the rubber tire (41) is caused to contact with the center of the bottom surface (6) of the boat. After that, the turning frame (13) is angularly moved and returned to its neutral position under restoring forces imposed by the coil springs (22). Stated otherwise, with the turning frame (13) returned to its neutral position, the direction of the boat guided by the rubber tire (41) can be corrected to align with the direction of the water flow. It is therefore possible to make the boat properly contact with the damping mechanism (35) and achieve positive speed damping while correcting the direction of travel of the boat.

Since the above-mentioned structure for correcting the direction of the boat can be small and compact, it does not result in the drawback of other direction correction structures which cause narrowing of the waterway width, and it can be installed even at a curved portion of the waterway (1) without undergoing any limitations to the configuration of the waterway (1). This is so even when the structure is placed in the waterway (1) at the boarding platform (3). Further, since the structure of the direction correcting damping device does not narrow the waterway width, the spacings between the boat (5) and the side walls of the waterway (1) can be held so large as to ensure safety of passengers.

The speed control apparatus (10) installed at the platform (3) is operated to bring a pleasure boat (5) to a complete stop at the location of the platform (3) because passengers have to board and leave the boat at the platform. On the contrary, the speed control apparatus (10) installed before the platform (3) may be set to either stop or just slow a succeeding boat (5), as this speed control apparatus (10) serves to adjust the timing to place a succeeding boat (5) in a waiting state depending on the situation of a preceding boat (5). In this manner, the speed control apparatus (10) positioned before the platform (3) with respect to the direction of travel of the boats controls the spacing between the boats, and is operated to perform control of stopping or speeding down a succeeding boat depending on the situation of the preceding boat.

For such control of slowing down the boat speed, a boat (5) can be stopped by setting a contact time longer in which the rubber tire (41) and the bottom surface (6) are held in contact with each other, and a rate of speeding down the boat can be reduced by setting the contact time shorter. As an alternative control scheme, the boat can be stopped by actuating the air cylinder (28) in such a manner as to increase the contact pressure between the rubber tire (41) and the bottom surface (6) of the boat, and a rate of speeding down the boat can be reduced by actuating the air cylinder (28) to produce a smaller contact pressure. Accordingly, the speed control of the boat can be performed by monitoring the behavior of the preceding boat using another sensor or the like and regulating the length of extension of the air cylinder or the period of time in which it is held in an extended state.

When the preceding boat is not stopped at the platform (3), the speed control apparatus (10) installed before the platform (3) may be kept inactive, with its lift arm (26) not raised, allowing the boat (5) to pass by the speed control apparatus without contacting the rubber tire (41).

Moreover, the friction forces produced between the hub (42) and the friction plates (45) can be adjusted by replacing the spacer (49) or the tightening force of the double nuts (50) to thereby vary the initial load of the plural conical plate springs (48).

Additionally, in the above-explained embodiment, since the member with which the bottom surface (6) of the boat comes into contact is the rubber tire (41) and the force of damping the boat (5) is generated due to the sliding resistance between the hub (42) supporting the rubber tire (41) and the friction plates (45), there is minimal sliding friction between the bottom surface (6) of the boat and the rubber tire (41) as the counterpart member, and thus there is no appreciable sliding wear of the bottom surface (6) of the boat. As a result, the hull is prevented from being damaged and maintenance of the boat hall is minimized.

It should be noted that the present invention is not limited to the foregoing embodiment.

More specifically, the damping mechanism (35) in the above embodiment has been described as comprising the rubber tire (41) coming into contact with the bottom surface (6) of the boat, the hub (42) supporting the rubber tire (41) and the friction plates (45), and mounting these members at the distal end of the lift arm (26) which is raised by the air cylinder (28). However, the damping mechanism may be practiced in various structures such as using the belt conveyor disclosed in the above-cited Japanese Utility Model Publication No. 45-12594; or a friction plate like a sleigh over which the bottom surface of the boat directly slides while producing friction therebetween.

Figure 7:
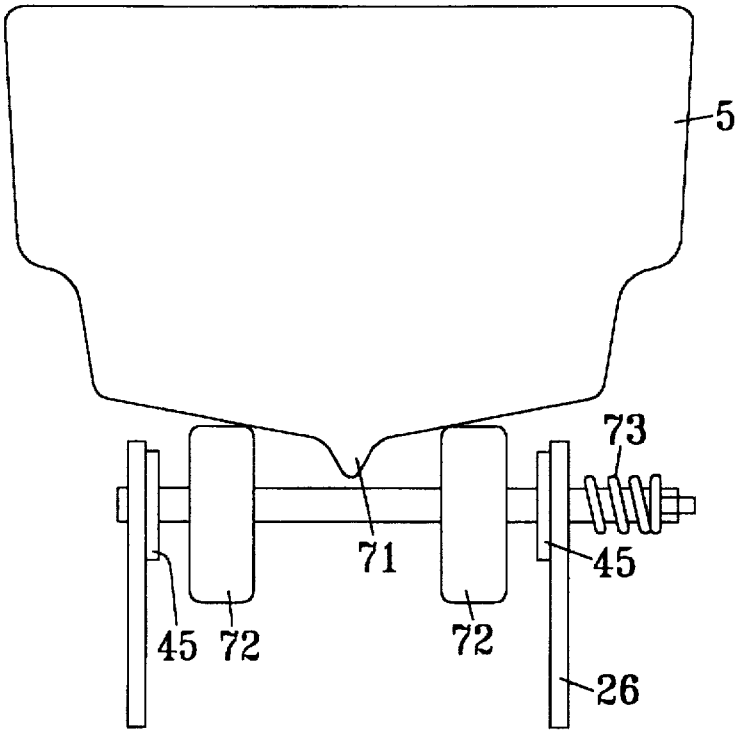
FIG. 7 is a view showing the relationship between the bottom of a boat and rubber tires according to a second embodiment of the present invention.

Further, the mechanism for correcting and guiding the attitude in contact between the bottom surface (6) of the boat and the rubber tire (41) is not limited to the combination of the bottom surface (6) of the boat having a concave shape peaking at the center and the single rubber tire (41) fitting into that peak. Like another embodiment shown in FIG. 7, for example, in the case of the pleasure boat (5) having a central rib such as a keel (71) projecting from the bottom surface, two rubber tires (72) may be provided on both sides of the keel (71) so that the keel (71) is guided between these rubber tires (72). Additionally, in the embodiment of FIG. 7, a coil spring (73) is used instead of the conical plate springs.

Also, the damping force may be adjusted by using an actuator, such as a solenoid or an air cylinder, instead of the conical plate springs (48) or the coil spring (73).

Further, the spring means for urging the turning frame (13) into the neutral position is not limited to a pair of the coil springs (22) as illustrated, and a single coil spring may be used to urge the turning frame (13) into the neutral position.

Finally, the vehicle advancing along the waterway is not limited to the pleasure boat and may be a simple boat or a raft.

According to the present invention, as described above, when a vehicle traveling along a waterway obliquely approaches a damping mechanism, the direction of the vehicle can be corrected to a proper direction of advance through both angularly-moving and restoring actions effected by a rotating frame and spring means, whereby the vehicle can be properly guided with respect to the damping mechanism. It is therefore possible to positively transmit a frictional damping force to the vehicle for smoothly speeding down or stopping it. Furthermore, since the damping mechanism requires no special guide plates which narrow the width of the waterway, and is of a small and compact structure, it can be installed at any position along the waterway to freely stop or speed down the vehicle. In addition, because there is no need to narrow the width of the waterway, such hazardous accidents that could occur by a passenger extending a limb outside of the vehicle which may be pinched between the guide plate and the vehicle can be eliminated or greatly reduced.

I claim:

1. A speed control device for a water traveling vehicle comprising:

a base fixed below the surface of the water;

a lifting arm having a pivot end and a lifting end, said lifting arm pivotally mounted at said pivot end on said base;

a hub rotatably mounted to said lifting end of said lifting arm;

a wheel mounted on said hub;

a friction plate mounted on said lifting arm and positioned to make frictional contact with said hub and thereby create resistance to dampen the rotation of said hub and said wheel;

wherein said wheel is positioned to physically contact the bottom of the water traveling vehicle and be rotated by the movement of the water traveling vehicle surface upon the wheel;

wherein the rotation of said hub and said wheel is dampened by the frictional hold of said friction plate on said hub; and whereby the water traveling vehicle in contact with said wheel is slowed or stopped by the frictional force necessary to rotate said wheel and said hub against the resistance of the friction plate.

2. A speed control device as in claim 1 further comprising:

a turning frame mounted between said base and said lifting arm to permit angular rotation, in a substantially horizontal plane, of said lifting arm about said base;

a spring biasing said lifting arm to a predetermined direction parallel to a chosen course of travel for the water traveling vehicle, wherein contact with said wheel by the water traveling vehicle when it is aligned obliquely with respect to a direction of the chosen course of travel for the vehicle angularly moves said wheel and said lifting arm on said turning frame to a direction parallel to the oblique alignment of the vehicle, and wherein said spring returns said lifting arm and said wheel to align substantially parallel to the direction of the chosen course of travel for the vehicle thereby turning the vehicle, in frictional contact with said wheel, to a direction substantially parallel to the direction of the chosen course of travel for the water traveling vehicle.

3. A speed control device as in claim 1 further comprising:

a lifting means to raise and lower the lifting end of said lifting arm between a lowered position and a raised position, wherein the lowered position allows passage of the water traveling vehicle passing above said speed control device without physically contacting said wheel of said speed control device and the raised position allows said wheel of said speed control device to physically contact a bottom surface of the water traveling vehicle when passing above said speed control device.

4. A speed control device as in claim 3 further comprising a sensor to sense the approach of the water traveling vehicle when traveling toward said speed control device, said sensor sending a signal to said lifting means to raise or lower said lifting arm between said raised position and said lowered position, to position said wheel to contact said bottom surface of the water traveling vehicle in said raised position, or allow unimpeded passage of the water traveling vehicle when traveling over said speed control device in said lowered position, according to a predetermined timing of the movement of the water traveling vehicle.

5. A system for controlling the speed of a plurality of water traveling vehicles comprising:

a water way configured to contain a level of water for the travel of the water traveling vehicles;

a speed control device comprising:

a base fixed below the surface of the water;

a lifting arm having a pivot end and a lifting end, said lifting arm pivotally mounted at said pivot end on said base;

a hub rotatably mounted to said lifting end of said lifting arm;

a wheel mounted on said hub to rotate therewith;

a friction plate mounted on said lifting arm and positioned to make frictional contact with said hub and thereby create resistance to the rotation of said hub and said wheel;

a lifting means to raise and lower the lifting end of said lifting arm between a lowered position and a raised position;

a sensor to sense the approach of one of the water traveling vehicles traveling toward said speed control device, said sensor sending a signal to said lifting means to raise or lower said lifting arm between said raised position and said lowered position, to position said wheel to either contact a bottom surface of the one water traveling vehicle when said lifting arm is in said raised position, or allow unimpeded passage of the one water traveling vehicle by said speed control device when the lifting arm is in said lowered position, according to a predetermined timing of the movement of the one water traveling vehicle, wherein the rotation of said hub and said wheel is damped by the frictional hold of said friction plate on said hub when said lifting arm is in the raised position; and whereby the one water traveling vehicle in contact with said wheel is slowed or stopped by the frictional force necessary to rotate said wheel and said hub against the resistance of the friction plate when the lifting arm is in the raised position.

6. A system to control the speed of a plurality of vehicles traveling at least in part through water by floating thereupon comprising:

a plurality of speed control devices, each comprising:

a base fixed below the surface of the water;

a lifting arm having a pivot end and a lifting end, said lifting arm pivotally mounted at said pivot end on said base;

a hub rotatably mounted to said lifting end of said lifting arm;

a wheel mounted on said hub to rotate therewith;

a friction plate mounted on said lifting arm positioned to make frictional contact with said hub and thereby create resistance to the rotation of said hub and said wheel;

a lifting control to raise and lower the lifting end of said lifting arm between a lowered position and a raised position;

a plurality of sensors to sense the approach of said water traveling vehicles relative to the plurality of speed control devices, said sensors configured to send a signal to said lifting controls of said speed control devices to raise or lower said lifting arms of said speed control devices between the raised position and the lowered position, wherein the speed of a particular vehicle is controlled at a particular point of travel within the waterway by selective activation of a particular lifting control of a particular speed control device by a particular sensor sensing the approach of the particular vehicle traveling toward the particular speed control device, wherein the particular vehicle is slowed or stopped by activation of the particular lifting control of the particular speed control device by the particular sensor, so that the lifting arm of the particular speed control device is raised to the raised position wherein the wheel of said particular speed control device is positioned to contact a bottom surface of the particular vehicle to be slowed or stopped, and the rotation of said hub and said wheel is dampened by the frictional hold of said friction plate on said hub whereby the particular vehicle in contact with said wheel is slowed or stopped by the frictional force necessary to rotate said wheel and said hub against the resistance of the friction plates; and wherein said particular sensor signals said particular lifting control to lower said lifting arm to the lowered position to lower said wheel of said particular speed control device or allow unrestricted travel of the particular vehicle according to a predetermined timing of travel of the water traveling vehicles.

7. A speed control apparatus for a waterway traveling vehicle used in pleasure equipment when said vehicle is set afloat in a waterway and travels along said waterway, and when a damping mechanism is provided in the course of said waterway for coming into contact with said vehicle and stopping or speeding down said vehicle due to friction when said vehicle approaches, wherein:

a turning frame guided by a guide member to angularly move is provided at a predetermined position along said waterway in an angularly movable manner, said turning frame is urged by spring means toward a predetermined direction, and said damping mechanism is mounted to said turning frame, whereby when said vehicle approaches said damping mechanism slantly with respect to a predetermined direction of advance, said turning frame is angularly moved against said spring means to make said damping mechanism move in the direction of said vehicle and then angularly move to return to the predetermined direction under an urging action of said spring means for correcting the direction of said vehicle to the predetermined direction of advance.

8. A speed control apparatus for a waterway traveling vehicle according to claim 7, wherein said damping mechanism for stopping or speeding down said vehicle comprises:

an elastic wheel coming into contact with said vehicle and rotated as said vehicle advances, a friction plate for damping the rotation of said wheel, a lift arm supporting said wheel and said friction plate and mounted to said turning frame to be capable of rising and lowering, and an actuator for controlling said lift arm to raise and lower said lift arm.

9. A speed control apparatus for a waterway traveling vehicle according to claim 8, wherein a bottom surface of said vehicle and said elastic wheel cooperatively constitute a guide mechanism for making the center of said vehicle aligned with the center of said damping mechanism.

10. An apparatus for controlling a water traveling vehicle intended to travel in a predetermined direction along a waterway, comprising:

a base mounted in said waterway, said base substantially defining a planar surface;

a vehicle speed control structure mounted on said base and having at least a portion thereof coming in contact with said vehicle to control said vehicle along said waterway, said vehicle speed control structure configured to enable rotation relative to said base about an axis substantially perpendicular to said planar surface, so as to accommodate said vehicle being offset from said predetermined direction when said vehicle and said portion come into contact.

11. An apparatus of claim 10, wherein said base includes a guide rail and said vehicle speed control structure includes a roller engaging said guide rail to facilitate said relative rotation between said vehicle speed control structure and said base.

12. An apparatus of claim 10, further comprising at least one stopper mounted on said base to limit a range of said relative rotation.

13. An apparatus of claim 10, further comprising a biasing device biasing said vehicle speed control structure toward a position relative to the base.

14. An apparatus of claim 13, wherein said position coincides with said predetermined direction along the waterway.

15. An apparatus of claim 10, wherein said vehicle speed control structure includes:

a movable member having an end;

a friction-inducing member mounted on said end; and an actuator actuating said movable member to place said friction-inducing member into contact said vehicle.

16. An apparatus of claim 15, wherein said friction-inducing member includes:

a contact member;

at least one friction plate; and an energy transfer member positioned between said contact member and said friction plate.

17. An apparatus of claim 15, wherein said vehicle has a specially configured bottom which comes into contact with said friction-inducing member.

18. An apparatus of claim 15, wherein said actuator is configured to provide a range of contact times between said friction-inducing member and said vehicle.

19. An apparatus of claim 15, wherein said actuator is configured to provide a range of contact pressures between said friction-inducing member and said vehicle.

20. An apparatus of claim 10, wherein said vehicle speed control structure includes:

a movable member having a plurality of friction-inducing members;

an actuator actuating said movable member to place said friction-inducing members into contact with side portions of said vehicle.

21. An apparatus of claim 10, wherein friction induced by said vehicle speed control structure may be varied.

22. An apparatus of claim 10, further comprising:

at least one sensor configured to sense said vehicle relative to said vehicle speed control structure and selectively actuate said vehicle speed control structure to slow or stop said vehicle.

23. An apparatus of claim 10, further comprising:

a plurality of sensors and a plurality of vehicle speed control structures, a particular sensor configured to sense said vehicle relative to a particular vehicle speed control structure and to selectively actuate said particular vehicle speed control structure to slow or stop said vehicle.

24. An apparatus of claim 10, further comprising a ramp member to guide said vehicle onto said vehicle speed control structure.

* * * * *